United States Patent [19]

Hightower

[11] Patent Number: 4,511,070

[45] Date of Patent: Apr. 16, 1985

[54] ADJUSTABLE SLING FOR RIFLES, SHOTGUNS OR THE LIKE

[76] Inventor: Floyd Hightower, 5617 Lake Highlands Dr., Waco, Tex. 76710

[21] Appl. No.: 513,310

[22] Filed: Jul. 13, 1983

[51] Int. Cl.[3] ..... F41C 27/00

[52] U.S. Cl. ..... 224/150; 224/913

[58] Field of Search ..... 224/913, 150, 203, 205, 224/257

[56] References Cited

U.S. PATENT DOCUMENTS

| | | | |
|---|---|---|---|
| 1,186,496 | 6/1916 | Randall | 224/913 X |
| 1,210,475 | 1/1917 | Hooper | 224/913 X |
| 1,292,875 | 1/1919 | Randall | 224/150 |
| 1,309,605 | 7/1919 | Badger | 224/913 X |
| 2,296,733 | 9/1942 | Paolino | 224/150 |
| 2,446,197 | 8/1948 | Sloan | 224/913 X |
| 2,550,433 | 4/1951 | Tichenor | 224/150 |
| 2,812,123 | 11/1957 | Girton | 224/151 X |
| 4,361,258 | 11/1982 | Clark | 224/150 |

*Primary Examiner*—Stephen Marcus

*Assistant Examiner*—Robert Petrik

*Attorney, Agent, or Firm*—Diller, Ramik & Wight

[57] ABSTRACT

This disclosure is directed to a sling for a rifle, shotgun or the like which is formed of a web of material folded upon itself to define first, second and third web portions with the second web portion being sandwiched between the first and third web portions, the sling being so folded as to have first and second overfolded opposite ends each carrying a connector for connecting the sling to a rifle, shotgun or the like, the first web portion passing through a loop, a third overfolded end portion entraining the loop at a point between the first and second overfolded end portions, and the loop being connected to one end of the web whereby the first web portion can be drawn selectively in opposite directions through the loop to increase or decrease the overall length of the sling and after any such adjustment, the first web portion is frictionally gripped in the loop area by the frictional engagement between the first web end and the third overfolded end portion.

12 Claims, 4 Drawing Figures

FIG.1
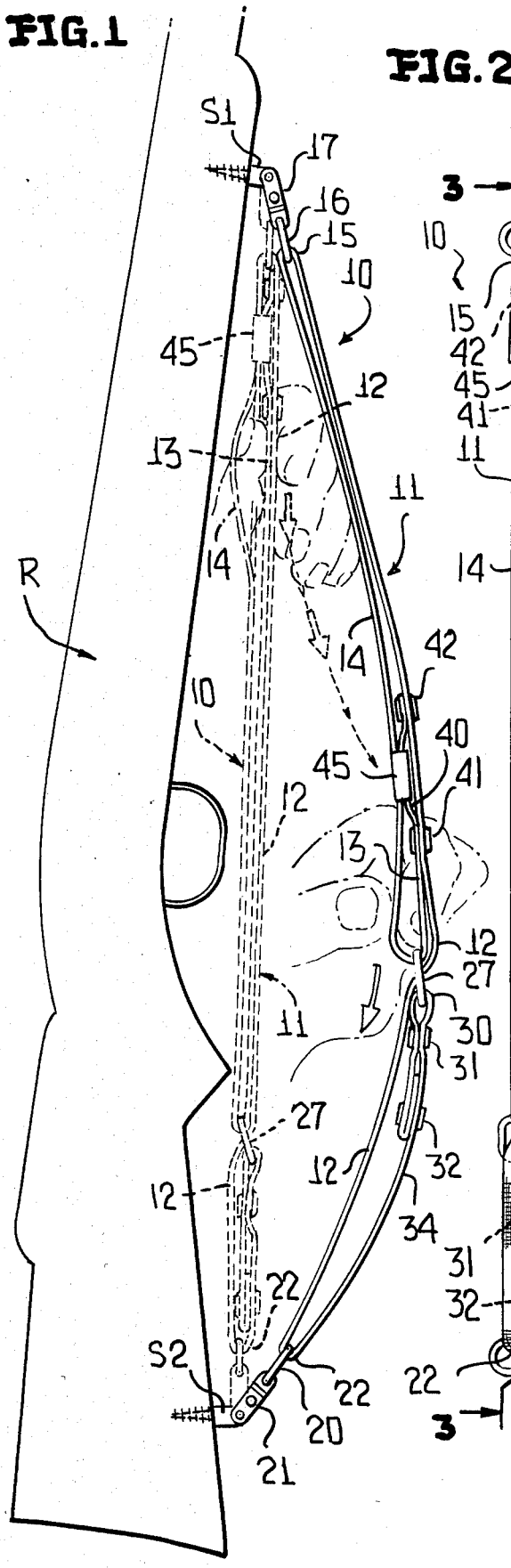
FIG.2
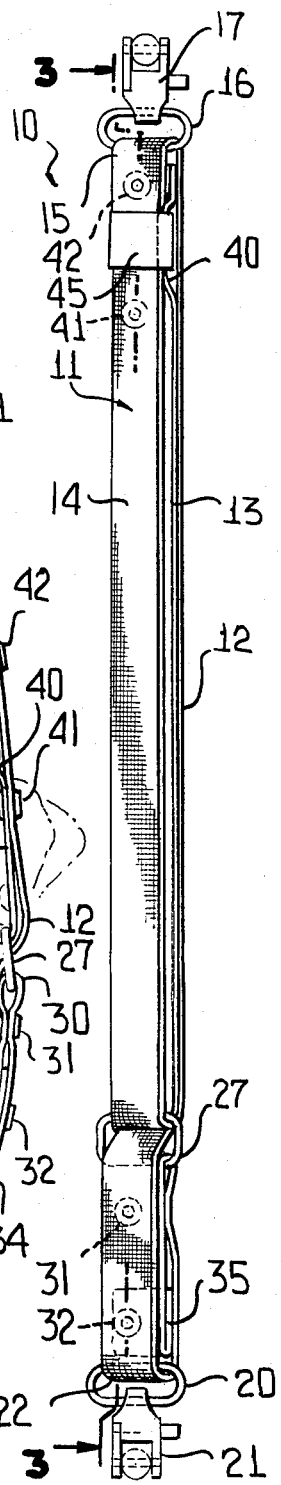
FIG.3
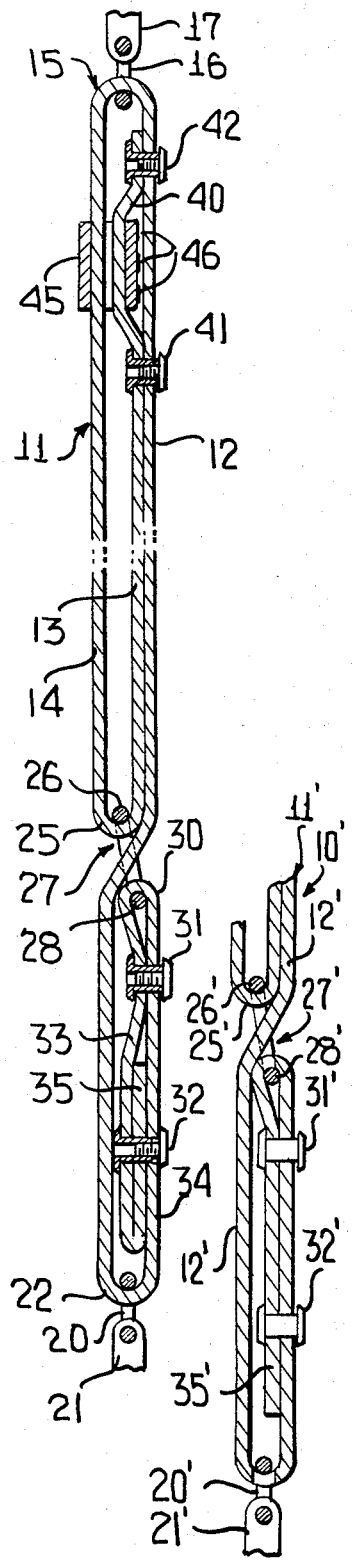
FIG.4

ADJUSTABLE SLING FOR RIFLES, SHOTGUNS OR THE LIKE

The present invention is directed to a sling for a rifle, shotgun or the like and is designed such as to be quickly adjustable while simultaneously being secured in any adjusted length thereby accommodating the sling to different measurements between the sling swivel studs on the rifles and/or shotguns of different manufacturers.

More specifically, the sling of the present invention is formed from a single web of material overfolded such as to define first, second and third web portions with the third web portion being sandwiched between the first and second web portions with all three web portions being at least partially entrained about a loop disposed medially of first and second axially opposite overfolded end portions of the web, connectors are carried by the first and second axially opposite overfolded end portions to secure the sling to rifle or shotgun swivel studs, and the loop is further connected to a free end of the web at a terminal overfolded portion whereby the first web portion is gripped between the latter overfolded portion and an overfolded web portion of the second and third web portions to hold the sling firmly in any adjusted position of length.

A further object of this invention is to provide a novel sling as aforesaid wherein the overfolding of the web is such that the side of the sling most adjacent the rifle's or shotgun's stock is devoid of any metal fittings and, thus, the sling can not scratch, blemish or otherwise mar the stock.

Still another object of this invention is to provide a novel sling as aforesaid wherein a loop of web material entraining the second web portion terminal end and the third web portion is confined in its movement by a pair of connecting studs between the first and second web portions, and the function of the web loop is to control the free play of the web material of the sling, particularly when the sling is shortened or closed.

With the above and other objects in view that will hereinafter appear, the nature of the invention will be more clearly understood by reference to the following detailed description, the appended claims and the several views illustrated in the accompanying drawing.

In the drawing:

FIG. 1 is a side elevational view of a novel sling of this invention in its extended position, and illustrates the same in phantom outline in its shortened position relative to a rifle or a shotgun.

FIG. 2 is a perspective view of the sling, and illustrates the manner in which a first web portion which passes through a square loop is sandwiched between two overfolded web portions for retaining any length of sling adjustment through the frictional purchase of the opposing material of the web in the area of the square loop.

FIG. 3 is a cross-sectional view taken generally along line 3—3 of FIG. 2, and illustrates details of the sling including the gripping action or frictional purchase in the area of the square loop.

FIG. 4 is a fragmentary sectional view of a portion of a modified sling, and illustrates the manner in which one end of the modified sling is formed to accommodate relatively longer rifles and shotguns than those accommodated by the sling of FIGS. 1 through 3 of the drawing.

A novel sling constructed in accordance with this invention is generally designated by the reference numeral 10, and the same is illustrated in FIGS. 1 through 3 of the drawings.

The sling 10 is preferably constructed from nylon webbing (MIL-W-27265C-Class R Resin Treated Type 25) which has two finished sides both of which can be exposed and/or utilized in the construction of the final sling 10. The webbing or elongated web is generally designated by the reference numeral 11 and includes a plurality of overfolded and/or superimposed web portions with a first web portion being generally designated by the reference numeral 12, a second web portion by the reference numeral 13, and a third web portion by the reference numeral 14. The second web portion 13 is generally sandwiched between the first web portion 12 and the third web portion 14, as is best illustrated in FIG. 3 of the drawing.

The web portions 12, 14 collectively define an overfolded terminal end portion or web portion 15 which passes through a conventional loop 16 of a conventional sling swivel 17 which is in turn connected to a conventional sling swivel stud S1 (FIG. 1) of a conventional rifle (R), shotgun or the like. The loop 16 and the swivel 17 form no part of the present invention.

A duplicate conventional loop 20 and an associated swivel 21 is connected to another conventional sling swivel stud S2 of the rifle (R), shotgun or the like, again as is best illustrated in FIG. 1 of the drawing. The loop 20 is entrained by an overfolded end portion or web portion 22 which is axially remote from the overfolded end portion 15.

The second and third web portions 13 and 14, respectively, cooperatively define a third overfolded web portion 25 which entrains and is partially entrained by a leg 26 of a metallic square loop 27. Another leg 28 of the loop 27 parallel to the leg 26 is entrained by a fourth overfolded web portion 30 which is in part formed as a continuation of the first web portion 12 passing through the loop 27, the loop 20, and then being entrained about the leg 28 of the loop 27. Connection means in the form of "Chicago" screws 31, 32 fasten overlying web portions 33, 34 together with a free or terminal end 35 of the web 11 being sandwiched between the overlying web portions 33, 34.

A terminal end 40 of the second web portion 13 is similarly connected by connection means, also in the form of "Chicago" screws 41, 42 to the first web portion 12 adjacent the overfolded web portion 15. Another loop 45 constructed from the same material as that of the material of the web 11 surrounds and is in external telescopic relationship to the end 40 and a portion of the third web portion 14 between the overfolded web portions 15, 25. The web loop 45 has aligned abutting edges which are connected together by conventional staples 46.

Reference is now made to FIG. 1 which illustrates the sling in two different positions, but in each position the third web portion 14 is the innermost or most adjacent side of the sling 10 opposing the stock (unnumbered) of the rifle (R). Assuming that the sling 10 has been secured to the rifle (R) and is in the shortest or phantom outline position, and it is desired to adjust the length of the sling 10 by lengthening the same, one merely grips the first and second web portions 12 and 13, respectively, simultaneously and adjacent the screw 41 and impart a downward pull toward the butt (unnumbered) of the rifle (R). It should be noted that the rifle (R) can be held in one hand while this gripping and pulling takes place with the other hand and during the latter, and third web portion 14 is drawn progressivelly and continuously through the loop 16 overcoming the frictional purchase or engagement between the web loop 45 and the third web portion 13 sliding thereagainst. This same downward movement relaxes the taut condition of this web portion passing through the loop 27 and, thus, releases the frictional purchase applied thereto by the surfaces of the overfolded web portions 25, 30 bearing against opposite sides of the first web portion 12 passing through the loop 27. In this manner the frictional locking engagement at the loop 27 is released and the loop 45 progressively controls the free play of the web during its adjustment period. Obviously, as the web portion 12 passes through the loop 27 toward the loop 20 and therealong effective total overall length of the sling 10 is increased and this increase can continue until the loop 45 is at the leg 26 and further motion is precluded thereby. Hence, lengthening of the sling 10 requires merely grasping the web portions 12, 13 simultaneously and pulling the same downwardly from the uppermost position shown in phantom outline to whatever lower position is appropriate.

The manner in which the sling 10 is decreased in size is as simple as that involved in lengthening the sling 10, namely, one merely grasps only the third web portion 14 immediately adjacent and slightly below the web loop 45, as indicated by the lowermost hand in FIG. 1, and pulls downwardly in a repetitive fashion. This progressively pulls the third web portion 14 through the loop 16 which in turn draws the end 40 upwardly and the first web portion 12 upwardly through the loop 27, thus drawing the loop 20 closer toward the loop 16 and effectively shortening the overall length of the sling. As in the case of lengthening the sling 10, the latter can be performed while the rifle (R) is held in one hand and the other hand of the user shortens the sling 10.

Reference is now made to FIG. 4 of the drawing which illustrates a modification or variation in the sling 10 and in this case the only difference lies in the fact that the sandwiched end 35 of the sling 10 of FIG. 3 is no longer sandwiched but is instead directly connected to the portion 34 thereby increasing the overall effective length of the sling 10' for the same length of web material. Thus, the sling 10 of FIGS. 1 through 3 can be utilized with rifles or shotguns of relatively short lengths between the mounting studs S1, S2 (25" to 26½"), whereas the sling 10' can be attached to the studs S1, S2 if they are spaced apart a distance more than 26½".

Although only a preferred embodiment of the invention has been specifically illustrated and described herein, it is to be understood that minor variations may be made in the apparatus without departing from the spirit and scope of the invention, as defined in the appended claims.

I claim:

1. A sling for a rifle, shotgun or the like comprising an elongated web of material folded upon itself to define axially opposite first and second overfolded end portions, a separate loop disposed between said overfolded end portions, means for connecting said separate loop to a first end of said web immediately adjacent said first overfolded end portion, said web including first second and third web portions disposed at least partially in superposed adjacent relatively sliding relationship, said first web portion passing through said separate loop and forming an integral extension between said opposite overfolded end portions, said second web portion being sandwiched between said first and third web portions, said second and third web portions collectively defining a third overfolded end portion passing through and partially entraining said separate loop, and said first web portion being in sandwiched relationship to said third overfolded end portion and said web first end whereby said first web portion can be slid through said separate loop in either of two opposite directions to selectively lengthen or shorten the distance between said connecting means and thereby effectively lengthen or shorten said sling.

2. The sling as defined in claim 1 wherein said connecting means includes a fourth overfolded end portion entraining said separate loop, and said sling being maintained in any position of length by the frictional gripping engagement of said third and fourth overfolded end portions against said first web portion.

3. The sling as defined in claim 1 wherein said web includes a second end defined by said second web portion disposed adjacent said second overfolded end portion, and loop means surrounding said second end and said third web portion for controlling the relative sliding movement of said third web portion during the selecting lengthening or shortening of said sling.

4. The sling as defined in claim 1 wherein said web includes a second end defined by said second web portion disposed adjacent said second overfolded end portion, loop means surrounding said second end and said third web portion for controlling the relative sliding movement of said third web portion during the selective lengthening or shortening of said sling, and means for confining the location of said loop means at said second end.

5. The sling as defined in claim 1 wherein said web includes a second end defined by said second web portion disposed adjacent said second overfolded end portion, loop means surrounding said second end and said third web portion for controlling the relative sliding movement of said third web portion during the selective lengthening or shortening of said sling, means for confining the location of said loop means at said second end, said confining means being defined by two spaced means for connecting said second end to said first web portion, and said loop means being disposed in surrounding relationship to said second end between said two spaced connecting means.

6. The sling as defined in claim 1 wherein said web includes a second end defined by said second web portion disposed adjacent said second overfolded end portion, loop means surrounding said second end and said third web portion for controlling the relative sliding movement of said third web portion during the selective lengthening or shortening of said sling, means for confining the location of said loop means at said second end, said confining means being defined by two spaced means for connecting said second end to said first web portion, said loop means being disposed in surrounding relationship to said second end between said two spaced connecting means, and said loop means being a web of material corresponding to said first-mentioned material.

7. The sling as defined in claim 1 wherein said web includes a second end defined by said second web portion disposed adjacent said second overfolded end portion, loop means surrounding said second end and said third web portion for controlling the relative sliding movement of said third web portion during the selective lengthening or shortening of said sling, means for confining the location of said loop means at said second end, and said second end being in sandwiched relationship between said loop means and said third web portion.

8. The sling as defined in claim 2 wherein said web includes a second end defined by said second web portion disposed adjacent said second overfolded end portion, and loop means surrounding said second end and said third web portion for controlling the relative sliding movement of said third web portion during the selecting lengthening or shortening of said sling.

9. The sling as defined in claim 2 wherein said web includes a second end defined by said second web portion disposed adjacent said second overfolded end portion, loop means surrounding said second end and said third web portion for controlling the relative sliding movement of said third web portion during the selective lengthening or shortening of said sling, and means for confining the location of said loop means at said second end.

10. The sling as defined in claim 2 wherein said web includes a second end defined by said second web portion disposed adjacent said second overfolded end portion, loop means surrounding said second end and said third web portion for controlling the relative sliding movement of said third web portion during the selective lengthening or shortening of said sling, means for confining the location of said loop means at said second end, said confining means being definined by two spaced means for connecting said second end to said first web portion, and said loop means being disposed in surrounding relationship to said second end between said two spaced connecting means.

11. The sling as defined in claim 2 wherein said web includes a second end defined by said second web portion disposed adjacent said second overfolded end portion, loop means surrounding said second end and said third web portion for controlling the relative sliding movement of said third web portion during the selective lengthening or shortening of said sling, means for confining the location of said loop means at said second end, said confining means being defined by two spaced means for connecting said second end to said first web portion, said loop means being disposed in surrounding relationship to said second end between said two spaced connecting means, and said loop means being a web of material corresponding to said first-mentioned material.

12. The sling as defined in claim 2 wherein said web includes a second end defined by said second web portion disposed adjacent said second overfolded end portion, loop means surrounding said second end and said third web portion for controlling the relative sliding movement of said third web portion during the selective lengthening or shortening of said sling, means for confining the location of said loop means at said second end, and said second end being in sandwiched relationship between said loop means and said third web portion.

* * * * *